United States Patent [19]

Brittain et al.

[11] Patent Number: 5,019,802

[45] Date of Patent: May 28, 1991

[54] INTRUSION DETECTION APPARATUS

[76] Inventors: Raymond C. Brittain, 2133 W. Highland Ave., Phoenix, Ariz. 85015; Roy Gomez, 1307 E. Sequoia Dr., Phoenix, Ariz. 85024

[21] Appl. No.: 451,096

[22] Filed: Dec. 15, 1989

[51] Int. Cl.[5] ..... G08B 19/00

[52] U.S. Cl. ..... 340/522; 340/506; 340/531; 340/566; 340/573; 340/691

[58] Field of Search ..... 340/522, 531, 506, 517, 340/566, 573, 691

[56] References Cited

U.S. PATENT DOCUMENTS 4,536,747 8/1985 Jensen ..... 340/522

4,710,750 12/1987 Johnson ..... 340/522

4,882,567 11/1989 Johnson ..... 340/522

*Primary Examiner*—Donnie L. Crosland

*Attorney, Agent, or Firm*—H. Gordon Shields

[57] ABSTRACT

Intrusion detection apparatus for detecting the intrusion within a predetermined area utilizes two detectors, a microwave detector and an infrared detector for providing an ouptut signal indicative of intrusion when both detectors detect an intrusion. The system is controlled by a key pad having a predetermined code for both enabling and disabling the system. Different types of outputs may be provided, depending on the desires of the users of the apparatus.

15 Claims, 1 Drawing Sheet

INTRUSION DETECTION APPARATUS

BACKGROUND OF THE INVENTION

1. Field of the Invention

This invention relates to intrusion detection apparatus and, more particularly, to intrusion detector apparatus utilizing two detectors and appropriate arming and disarming elements and intrusion detector alarms.

2. Description of the Prior Art

U.S. Pat. No. 4,772,875 (Maddox et al) discloses a portable intrusion detector system utilizing two types of sensors. One sensor monitors a first condition, and a second sensor monitors a second condition. Both sensors must detect an intrusion before an intrusion status is transmitted.

U.S. Pat. No .4,833,450 (Buccola and Kolb) discloses an intrusion detection system utilizing a microwave system and a passive infrared subsystem. Both systems must produce an output signal indicative of an intrusion in order for the system to produce an alarm. The system also includes its own monitoring system for detecting faulty equipment or elements.

U.S. Pat. No. 4,710,750 (Johnson) discloses another dual sensor type of intrusion detection system. A passive infrared sensor is combined with a microwave sensor. A counter system is utilized by the apparatus. The counts of the two separate systems or detectors are compared for purposes of determining a fault in one of the two sensor systems. An intrusion must be detected by both systems in order for an alarm to be sounded.

U.S. Pat. No. 4,660,024 (McMaster) discloses a dual detection system, with both systems having to detect an intrusion before an alarm is provided. In addition, the apparatus includes malfunction or fault detecting apparatus. If a fault is detected in one of the systems, an alarm indicative of such is transmitted.

U.S. Pat. No. 4,625,199 (Pantus) discloses another type of dual system intrusion detection apparatus being ultrasonic and microwave detection subsystems. Both subsystems must detect an intrusion in order for an appropriate alarm to be transmitted.

U.S. Pat. No. 4,611,297 (Sansky) discloses a multiple sensor status monitoring system for monitoring the status of an area and for monitoring the sensing apparatus to detect and identify faulty sensors. An alarm system is transmitted or generated only if two sensors give a positive response to an intrusion within a predetermined time period. The apparatus includes latching elements to keep track of the spurious responses of the sensors, and to provide a visual display of the kept record.

U.S. Pat. No. 4,401,976 (Stadelmayr) discloses a multiple sensor system disposed at different locations and responsive to different physical phenomenon coupled together to provide an output when a majority of the sensors respond to a detected intrusion. Infrared sensors, microwave sensors, and ultrasonic sensors may each be utilized. That is, different types of sensors are utilized in the overall system.

U.S. Pat. No. 4,195,296 (Williams) discloses an intrusion detection system utilizing microwaves and the Doppler principle for detecting an intrusion.

U.S. Pat. No. 3,801,978 (Gershberg and Lee) discloses a dual detection system for detecting an intrusion utilizing an ultrasonic detector and a microwave detector, both of which must detect an intrusion in order for an alarm to sound.

U.S. Pat. No. 3,725,888 (Solomon) discloses a detector system utilizing a microwave detector and an optical detector. Again, both detectors must provide an output signal in order for an alarm signal to be produced.

U.S. Pat. No. 3,074,054 (Pearson) discloses a detection or intrusion system in which two different types of detectors are also used and an output signal from each of the systems is required in order to provide an intrusion output signal. An ultrasonic system and a microwave system are used in the apparatus.

U.S. Pat. No. 3,074,053 (McDonough et al) discloses another type of dual detector system for detecting intrusions. A photoelectric system and a capacitive system are utilized. Both systems must detect an intrusion before an alarm system is generated.

It will be noted that in the above-discussed patents, the circuitry involved is of paramount importance. Details of the activation and deactivation of the systems appear to be secondary. In several of the patents, the self-policing feature of detecting faults is also of primary importance. However, the practical application of the intrusion systems is not dealt with. Moreover, the intrusion detection systems are generally concerned with a broad spectrum of applications, such as detecting an intrusion in a predetermined area, such as a room, grounds, or the like. Of primary importance is the circuitry involved, with the particular space or area of secondary concern. In the apparatus of the present invention, two detector systems are utilized for confirmation purposes, but it is of primary importance to both provide a positive output signal when an intrusion is detected and to be able to selectively arm and disarm the intrusion detector system by a limited number of persons. That is, a child, for example, could not simply turn the system on or off to enable or to disable the system. Moreover, the apparatus is designed primarily for detecting intrusion, as by a child, in the area about a swimming pool so that an alert may be sounded before the child falls into the pool, as opposed to an alert after the child has already fallen into the pool.

The invention described and claimed herein comprises intrusion alert system utilizing two detectors, an infrared detector and a microwave detector, the outputs of which are coupled together to provide an output signal indicative of an intrusion when both systems detect such intrusion. The apparatus is enabled and disabled through a key pad system to provide that only the individuals knowing a particular code for the system can actually accomplish either the disabling or the enabling of the system. A pulse counter is utilized so that both detectors must confirm the intrusion within a predetermined period of time before an alarm sounds. Different types of alarms may be provided. An audible alarm, a visual alarm, and a telephonically transmitted alarm may each or all be utilized with the system.

Among the objects of the present invention are the following:

To provide new and useful intrusions detection apparatus utilizing infrared and microwave detectors;

To provide new and useful intrusion detection apparatus controlled by a coded key pad;

To provide new and useful intrusion detection apparatus utilizing two different types of detectors for confirming intrusion;

To provide new and useful intrusion detection apparatus having two detectors, each of which must provide an output signal within a predetermined time period confirming an intrusion in order to provide an output signal; and To provide new and useful intrusion detection apparatus utilizing dual detectors and monitoring heat, movement, and mass for providing an output signal indicative of intrusion.

DESCRIPTION OF THE PREFERRED EMBODIMENT

Figure 1:
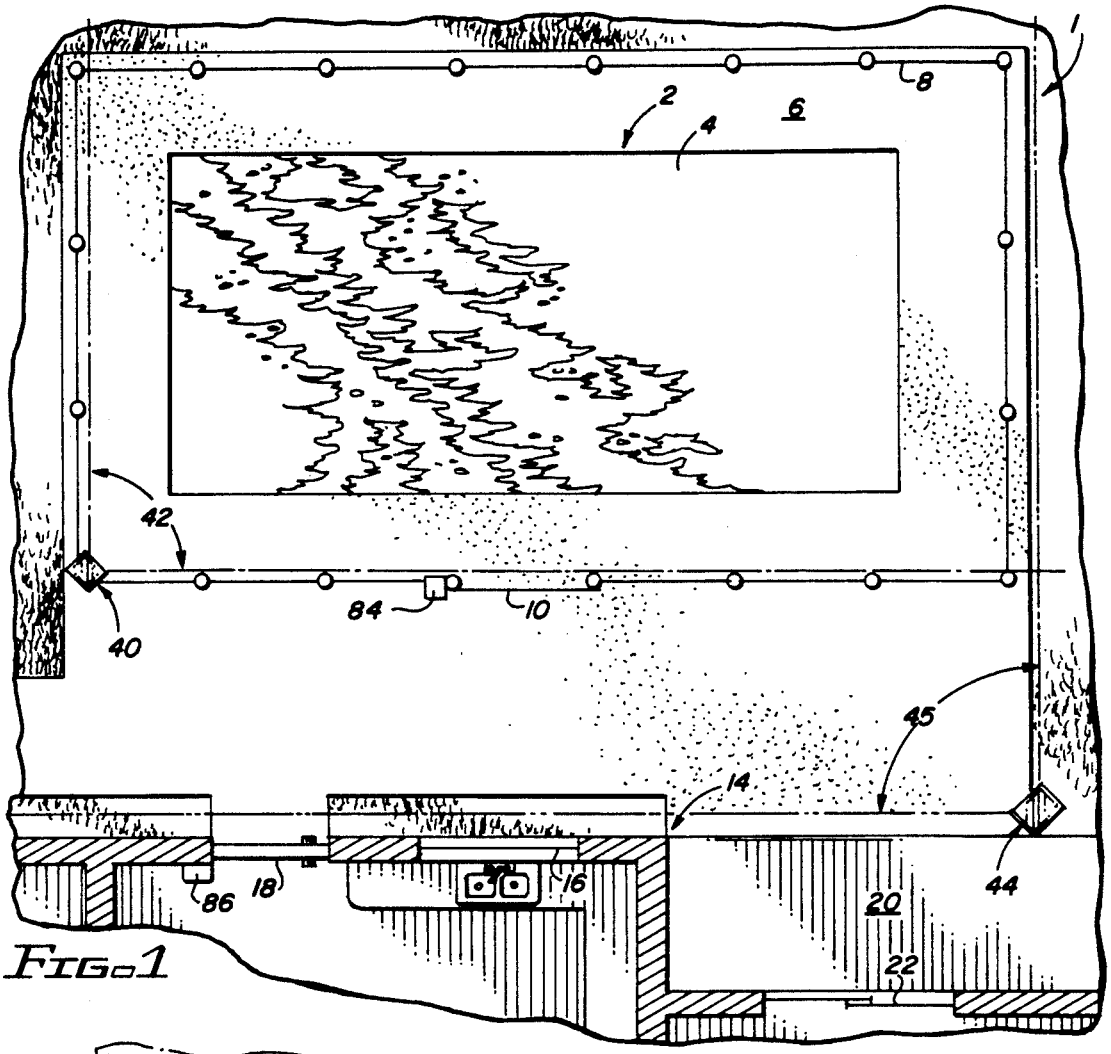
FIG. 1 is a plan view in partial section illustrating the apparatus of the present invention in its use environment.

FIG. 1 is a plan view of the use environment of the apparatus of the present invention illustrating the sue of the present invention in the environment. Included in FIG. 1 is a yard 1, and within the yard 1 is a swimming pool 2. Within the pool 2 is water 4, and about the pool 2 is a pool deck 6. A fence 8 is shown illustratively enclosing the pool 2 and a portion of the deck 6. The fence 8 includes a gate 10.

Also shown in FIG. 1 is a portion of a home 14. The home 14 includes a kitchen window 16 through which a person in the home may observe the pool 4, the pool deck 6, the fence 8, and portions of the adjacent yard 1. There is also a kitchen door 18 providing access to the yard 1.

Adjacent to the kitchen 14 is a patio 20. A patio door 22 provides communication between the interior of the home and the patio 20. From the patio, or from the door 18, access is provided into the yard 1, including the pool 2 and the pool deck 6 through the gate 10 of the fence 8.

Disposed on a corner of the fence 10 in the yard 1 is alarm apparatus 40. The alarm apparatus 40 includes a pattern 42 which covers essentially the fence 8, the gate 10 of the fence, the pool 2 and the pool deck 6 adjacent to the pool 2. The pattern 42 from the apparatus 40 covers the most likely areas of access to the pool 2.

Adjacent to the patio 20, and preferably affixed thereto at an upper portion thereof, is another alarm apparatus 44, which is substantially identical to the apparatus 40. The alarm apparatus 44 includes a pattern 45. The pattern 45 includes the area adjacent to the home 14, and the portion of the yard 1 outside of the deck 6, and including the fence 8, the gate 10 of the fence 8, and the pool 2. The primary difference between the alarm apparatus 40 and the apparatus 44 is the placement. The placement of the alarm 40 is down at a lower elevation and closer to the pool 2 and the fence 8. The alarm 44 is situated higher, aimed downwardly, but more remote from the pool 2 so as to provide coverage essentially from the house 14 outwardly, including the fence 8 and the gate 10.

The idea behind the placement of the apparatus 40 and the apparatus 44 is to alert people of intrusion in the area of the pool 4 before a child, or the like, has an opportunity to actually fall into the water 4 of the pool 2. Thus, the apparatus 40 provides a warning of intrusion into the area about the pool, rather than sounding an alarm after the specific area to be covered, namely the pool 2, has been entered, as is typical with the prior art. After the alarm sounds, as discussed in detail below, a person within the home or house 14, or in the yard 1, has an opportunity to intercept the intruder, such as a child, before the child has an opportunity to fall into the water 4. Thus, the alarm apparatus 40 is preventative, as opposed to remedial. The terms "preventative" and "remedial" refer respectively to an alarm system that provides a warning before a child can fall into a pool, and to an alarm system that provides a warning after a child has fallen into a pool.

Figure 2:
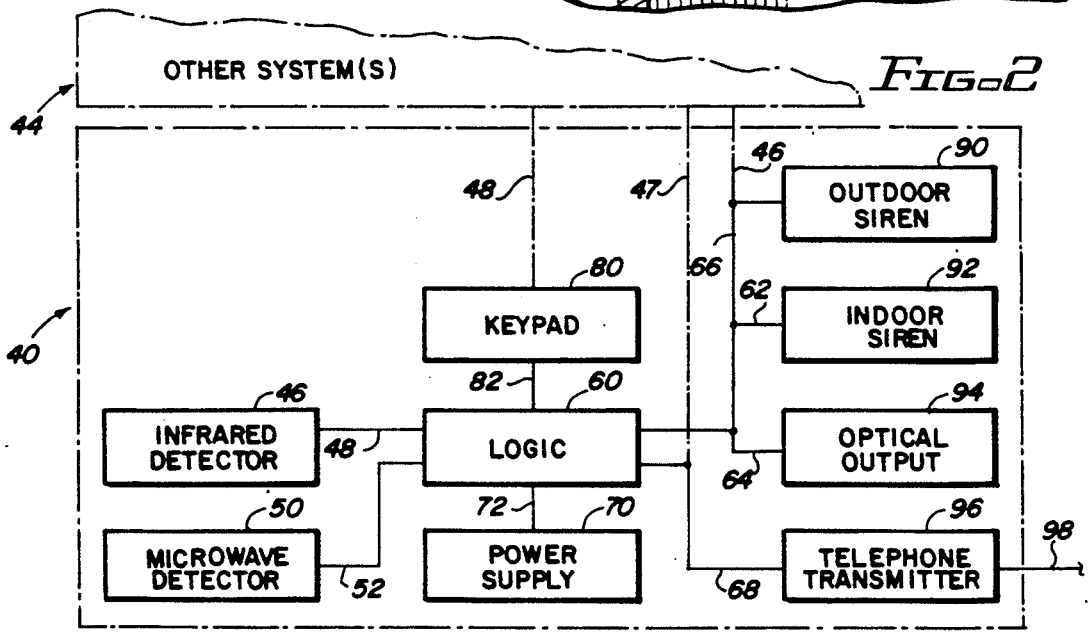
FIG. 2 is a block diagram of the elements involved in the apparatus of the present invention.

FIG. 2 is a schematic block diagram of the apparatus of the present invention. The alarm apparatus 40 includes two detectors, an infrared detector 46 and a microwave detector 50. The infrared detector 46 is a passive device sensitive to changes in infrared light waves, or heat, generated by an intruder moving within the infrared pattern 42 of the detector 46.

The microwave detector 50 uses radio waves in the microwave frequency portion of the electromagnetic spectrum to detect motion. The microwave pattern of the detector 50 is substantially coextensive with the pattern 42. Accordingly, only a single pattern 42 is shown, and the pattern 42 represents the pattern of both detectors 46 and 50. Utilizing the two detectors, infrared and microwave, a positive indication of intrusion will be detected before an alarm is sounded. The microwave detector 50 detects motion, while the infrared detector 146 detects primarily heat. In actuality, the infrared detector will also detect motion, but the motion detected is from the heat of the intruder.

Utilizing the two different types of detectors, different types of mistakes, or false intrusion signals, will be eliminated. For example, if a motion detector device, such as a microwave detector 50, is used by itself, then a movement in the area, as by leaves, a chair blown over, or the like, could set off the alarm. On the other hand, if an infrared device by itself is used, heat generated from various sources may alone be sufficient to set off the alarm. When both types of detectors are use, an alarm will not sound until both detectors have detected intrusion. This means that a combination of movement and heat must be sensed in order for an intrusion alarm to be sounded.

The infrared detector 46 is coupled to a logic block 60 through a conductor(s) 48. The microwave detector 50 is connected to the logic block 60 by conductor(s) 52. Appropriate logic, well known and understood, in the logic block 60 receives the output from the detectors 46 and 50 and provides an appropriate output, as discussed below, in response to an output from both the infrared detector 46 and the microwave detector 50. An output from either detector, alone, or by itself, will not result in an output from the logic block 60.

A pulse counter is included in the logic block 60. The pulse counter receives inputs from both detectors 46 and 50. If the separate inputs do not coincide within a predetermined time period, no output signal is provided. Or, to phrase the matter differently, input signals from both detectors must coincide within a predetermined time period in order to confirm an intrusion and thus to provide an output.

A power supply 70 is appropriately connected by conductor(s) 72 to the logic block 60. The power supply 70 also provides power for the infrared detector 46 and the microwave detector 50 through their respective conductors.

The logic block 60 is controlled by a key pad 80. The key pad 80 is connected to the logic block 60 by conductor(s) 82. In FIG. 1, a second key pad 84 is shown disposed adjacent to the gate 10 of the fence 8. If desired, the key pad 80 may be located adjacent to the logic block 60, the detectors 46 and 50, and the power supply 70 and also an output device, such as an outdoor siren 90, to provide all elements in a single package. Alternatively, the keypad may be located remotely from the package unit. Of, if desired, there may be the keypad 80 located at the unit 40, an additional keypad 84 located remotely from the unit 40, such as at the gate 10, and another additional keypad 86 within the home 14, such as in the kitchen adjacent to the door 86. In other words, the key pads may be remotely located with respect to the detectors 46 and 50, the logic 60, etc., and a keypad may be included in an integrated unit.

The purpose of the key pad 80 is to enable and disable the detectors 46 and 50 and the logic block 60 with respect to an output detecting intrusion into the pattern field or fields of the detectors. The detectors 46 and 50, the logic block 60, and the power supply 70, are in an "on" state virtually one hundred percent of the time. However, the key pad 80 controls the output of the logic 60 as far as the output devices are concerned. Only a person knowing the particular coded sequence could activate and deactivate the apparatus 40.

Typically, the key pad 80 may include ten keys, representing digits 0 through 9. A changeable combination of four digits may be used to activate and deactivate the alarm portions of the apparatus. Thus, all of the detectors 46 and 50 are always in the "on" state, and accordingly may detect both mass and movement on a relatively continuous basis. It is only when a predetermined four digit code is utilized through the key pad 80 to the logic 60 on conductor(s) 82 that the alarm elements will be activated in response to the detected movement and mass of the detectors 46 and 50.

Similarly, after an appropriate alarm has been sounded, a four number combination must be again keyed into the key pad 80 in order to deactivate the alarm elements. As indicated, the key pad 80 may be located at the unit 40, the keypad 84 may be located adjacent to the gate 10, or a keypad 86 may be located within the home 14, as desired. Or, if desired, only a single keypad may be used and it may be located at any desired location.

Four alarms are illustrated in FIG. 2. There is an outdoor siren or alarm 90, an indoor siren or alarm 92, an optical output 94, and a telephone transmitter 96. For the outdoor alarm 90, the indoor alarm 92, and the optical output 94, there is a common connection to the logic block 60. Appropriate conductor or conductors connect all three alarms to the logic block 60. Illustratively, a conductor 62 extends from the logic block 60 to the indoor alarm 92. A conductor 66 extends from the conductor 62 to the outdoor alarm 90, and a conductor 64 extends from the conductor 62 to the optical output 94. Obviously, separate conductors could also be used for each of the three outputs 90, 92, 94, as desired or as appropriate.

The outdoor alarm 90 is preferably located at the unit 40 or adjacent to the house or the yard 1 so as to provide an audible alarm to the exterior of the house 14. The indoor alarm 92 or indoor audio output is preferably located within the home 14. The alarms 90 and 92 are activated simultaneously to alert persons both within and without the home 14 of the detected intrusion.

Optical output 94 is directed primarily to the hearing impaired. However, it may be advantageous to provide the optical output 94 regardless of the hearing impairment status of the dwellers of the home 14. The optical output 94 could include some type of light bar or light bars or blinking lights within the dwelling 14 and also on the outside of the dwelling 14, as in the front of the house. In such cases, while outdoor alarms may alert neighbors that an intrusion has been detected, neighbors may not know specifically where the alarm is sounding from. That is, which particular home has a detected intrusion may be difficult to immediately determine with only an audible alarm. With an optical output at the front of the home, the specific location of the alarm is quickly determined with maximum speed or with minimum time of confusion after the intrusion has been detected and an audible alarm is sounded.

The telephone transmitter 96 is connected to the logic block 60 by a conductor 68. The telephone transmitter 96 is in turn connected to a telephone line(s) 98.

The telephone transmitter 96 is preset to automatically dial an emergency number, such as 911, in the event that the keypad 80 is not deactivated within a predetermined time period after an alarm sounds. For example, if the key pad 80 does not disarm the alarms 90, 92, and 94 within a predetermined time period, such as one minute, after the detectors 46 and 50 confirm an instruction, the telephone transmitter 96 is automatically activated to dial the predetermined emergency number. Thus, rather than depending on someone within the dwelling 14 to alert emergency personnel, the telephone transmitter 96 accomplishes that task automatically at the end of a predetermined time period.

Again, the use of the optical output 94 coupled with the telephone transmitter 96 provides a useful function in minimizing response time for emergency personnel. Even with an address, emergency personnel may waste precious seconds in locating the specific location at which they are needed.

If desired, appropriate diagram coding could be effected to stop the audible alarms 90 and 92, while allowing the alarms 94 and 96 to continue. For example, if a chile actually falls into the water 4 of the pool 2, it may be desirable to turn off the audible alarms but to let the optical alarm 94 and the telephone transmitter 96 continue. Appropriate coding may be provided for such occasion. Again, by way of example, three digits may disarm the audible alarms 90 and 92, but not the alarms 94 and 96.

In utilizing the intrusion apparatus 40, the paramount idea is the alerting of appropriate people that the area covered by the intrusion device 40 (and/or 44) has detected intrusion within the covered area. Typically, this means that, for example, a child has intruded into an area where the child should not be. The people alerted to the intrusion may respond before the child has an opportunity to either enter into the area of the pool 2, or even either climb the fence 8 or open the gate 10. With the escalations of drownings or near drownings, the apparatus of the present invention provides means of detecting a child before the child has the opportunity to fall into the water 4 of the pool 2.

At the same time, the use of the key pad 80 (or multiple keypads) allows the intrusion detector apparatus 40 to be selectively activated and deactivated, but only by proper personnel. This provides a double safety, with the apparatus 40 also serving as intrusion detection apparatus for burglars, or other unwanted persons, and at the same time protecting children from inadvertent access to the pool 2 and its water 4. Adults at the dwelling 14 would, of course, be knowledgeable about the combination for activating and deactivating the key pad 80. However, children and others would not be so knowledgeable. Thus, children could not deliberately deactivate the intrusion detector apparatus 40 without supervision. The likelihood of accidental drownings, or near drownings, accordingly decreases.

While intrusion detector apparatus is shown in two different locations, the apparatus 40 on the fence 8 within the yard 1, and the intrusion detector apparatus 44 on the patio 20 covering not only the pool area, but also a substantial portion of the yard 1 adjacent to the structure 14, it is also obvious that an intrusion detector apparatus could be located at another location, if desired. Located on the fence 8, the area covered by the intrusion detector apparatus 40 is more limited than the area covered by the detector apparatus 44. At the same time, the intrusion detector apparatus 40, located on the fence 8, covers a more limited area and accordingly gives less time after an intrusion is detected.

On the other hand, intrusion detector apparatus 40 located on the fence 8 does not cover the yard area immediately adjacent to the house 14 and the patio 20. Accordingly, children or others playing in that area are not affected by the intrusion detector apparatus, and the intrusion detector apparatus may accordingly be left in the "on" or monitoring state so as to detect only an intrusion into the fenced pool area. Children may play in the adjacent yard area without setting the alarm off. Only an intrusion through the gate 10 or through the fence 8 would be detected and would result in an output from the logic block 60 to the alarm elements 90, 92, 94 and the telephone transmitter 96 under the circumstances discussed above.

Returning again to the power supply 70, it is obvious that the power supply 70 is connected directly to household line current, such as 110/120 volt ac. However, in case of a failure of the household current, a backup power supply, such as batteries, may also be included. Typically, the various elements involved in the apparatus 40 operate on twelve or twenty-four volts dc. The power supply 70 accordingly includes the necessary transformers and rectifiers to provide the desired operating voltage. Rechargeable batteries are preferably used for a backup power supply. In case of a failure of the main power supply, the battery backup system takes over to provide the necessary current for the detectors 46 and 50 and also for the alarm elements 90, 92, 94, and 96.

While not shown, it is obvious that monitor element appropriate LEDs or the like, may also be incorporated apparatus 40. For example, appropriate LEDs incorporate apparatus 40, including the key pad 80, and the other and 86, should be located so as to provide an indication system is either in its on or monitoring state or in its Such indication should be visible from remote distances, a window 16, the door 18, or the like. While the system 44 observed from the 22, the keypad 84 on the fence 8 a the gate 10 is easily visible from the door 22, the window the door 18. The unit 40, shown in FIG. 1, is observed through the door 18 and the window 16, but probably not t door 22. If desired, and if the indoor keypad 86 is also visual indication could be included at the remote location as at the units themselves, and thus be readily visible from within the dwelling 14 as well as persons at various lo the yard 1.

Referring to both FIGS. 1 and 2, it will be noted apparatus 40 is self-contained in that the detector element 50, the logic 60, the power supply 70, the keypad 80 outdoor siren 90 may all be located within a single hou indoor alarm or siren 92 and the optical output alarm course, remotely located since of a necessity they will be conjunction with the structure 14. The telephone t could also be located within the apparatus housing conductor(s) 98 extending from the housing to appropriate telephone conductors on the exterior of the structure 14.

Similarly, the apparatus 44 may also be self-contained, as discussed above for the apparatus 40. However, in addition to the self-contained systems, there may be additional keypads located remotely from the apparatus housing. Such additional keypads are obviously for convenience. Thus, as illustrated and as discussed, the additional keypad 84 may be located adjacent to the gate 10 in a very convenient location. Similarly, another keypad 86 may be located within the dwelling 14 adjacent to the door 18 for purposes of convenience.

Thus, as illustrated herein, a "basic" system, comprising self-contained elements within a single housing, may be utilized by itself. An indoor alarm element, an optical alarm output, and a telephone transmitter may be included as additional features, and such additional features may be located remotely from the self-contained system. Similarly, additional keypads may be added for convenience, as desired.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What we claim is:

1. Intrusion alarm apparatus for a swimming pool comprising, in combination:

first detector means for detecting mass and for providing a first output in response to the detector mass in the area of the swimming pool;

second detector means for detecting movement and for providing a second output in response to the detected movement in the area of the swimming pool;

logic means for receiving the first and second outputs and for providing a third output in response to the received first and second outputs;

keypad means, including a keypad adjacent to the swimming pool, for enabling the logic means to provide the third output in response to a first predetermined code and for preventing a logic means from providing the third output in response to a second predetermined code; and first alarm means for receiving the third output and for providing at least a single alarm signal in response to the received third output.

2. The apparatus of claim 1 in which the first alarm means includes a first alarm and a second alarm remote from the first alarm, and both the first alarm and the second alarm are actuated by the third output.

3. The apparatus of claim 2 in which the first alarm means further includes a third alarm remote from the first and second alarms and actuated by the third output.

4. The apparatus of claim 1 in which the logic means further provides a fourth output responsive to the first and second outputs, and the intrusion alarm apparatus further includes telephone alarm means for providing an output telephone signal in response to the fourth output.

5. The apparatus of claim 4 in which the keypad means prevents the logic means from providing the fourth output in response to a third predetermined code.

6. The apparatus of claim 1 in which the keypad means includes a plurality of keypads.

7. The apparatus of claim 1 in which the first alarm means includes a plurality of alarm signals responsive to the third output from the logic means, and the keypad means includes means for disabling any of the plurality of alarm signals while allowing the remainder of the plurality of alarm signals to be provided.

8. Intrusion alarm apparatus for detecting intrusion in the area about a swimming pool, comprising, in combination:

first detector means, adjacent to the swimming pool for detecting mass and for providing a first output in response to the detected mass;

second detector means adjacent to the swimming pool for detecting movement and for providing a second output in response to the detected movement;

logic means for receiving the first and second outputs and for providing a third output in response to the received first and second outputs;

keypad means, including a keypad adjacent to the swimming pool, for enabling the logic means to provide the third output in response to a first predetermined code and for preventing the logic means from providing the third output in response to a second predetermined code; and alarm means, including first alarm means for receiving the third output and for providing a first alarm signal in response to the received third output, and second alarm means for receiving the third output and for providing a second alarm signal in response to the received third output.

9. The apparatus of claim 8 in which the first alarm means includes an audible alarm for providing an audible sound.

10. The apparatus of claim 9 in which the second alarm means comprises an optical alarm and the second alarm signal comprises a visually perceptible alarm signal.

11. The apparatus of claim 8 in which the logic means further provides a fourth output in response to the received first and second outputs.

12. The apparatus of claim 11 in which the alarm means further includes a third alarm means for providing a third alarm in response to the fourth output of the logic means.

13. The apparatus of claim 10 in which the keypad means includes means for selectively disabling the first alarm means while allowing the second alarm means to provide the second alarm signal.

14. The apparatus of claim 12 in which the third alarm means includes a telephone transmitter.

15. The apparatus of claim 14 in which the keypad means includes means for disabling the first alarm means and for enabling the second and third alarm means to provide the second and third alarms, respectively.

* * * * *